United States Patent [19]

Aellen

[11] Patent Number: 4,831,606

[45] Date of Patent: May 16, 1989

[54] WATCH, METHOD FOR THE ASSEMBLY THEREOF AND CAP THEREFOR

[75] Inventor: Pierre-Andrë Aellen, Le Landeron, Switzerland

[73] Assignee: ETA SA Fabriques d'Ebauches, Grenchen, Switzerland

[21] Appl. No.: 156,146

[22] Filed: Feb. 16, 1988

[30] Foreign Application Priority Data

Feb. 25, 1987 [CH] Switzerland ..... 711/87

[51] Int. Cl.[4] ..... G04B 37/00

[52] U.S. Cl. ..... 368/282; 368/283; 368/286

[58] Field of Search ..... 368/276, 281–282, 368/286; 224/164–179

[56] References Cited

U.S. PATENT DOCUMENTS

| | | | |
|---|---|---|---|
| 2,636,338 | 4/1953 | Dinstman | 368/286 |
| 3,242,664 | 3/1966 | Lederrey | 368/281 |
| 4,396,298 | 2/1983 | Ripley | 368/282 |

FOREIGN PATENT DOCUMENTS

| | | | |
|---|---|---|---|
| 483065 | 5/1917 | France . | |
| 1092554 | 4/1955 | France . | |
| 2329002 | 5/1977 | France . | |
| 1099773 | 2/1961 | Netherlands . | |
| 86244 | 1/1921 | Switzerland | 368/286 |
| 259513 | 8/1946 | Switzerland | 368/286 |
| 102641 | of 1916 | United Kingdom . | |
| 300153 | 11/1928 | United Kingdom | 368/286 |

*Primary Examiner*—Vit W. Miska

*Attorney, Agent, or Firm*—Griffin, Branigan & Butler

[57] ABSTRACT

A watch comprises a watch case, a glass, a wristlet, a cap and spindles, the watch case being constructed in one piece, the glass being sealed to the watch case, the cap at least partially covering the upper side of the watch, the wristlet being formed of two half wristlets. The half wristlets are secured one on each side of the case by means of the spindles which also secure the cap to the watch case.

10 Claims, 1 Drawing Sheet

WATCH, METHOD FOR THE ASSEMBLY THEREOF AND CAP THEREFOR

BACKGROUND OF THE INVENTION

1. Technical Field of the Invention

The present invention relates to a watch comprising a watch case constructed in one piece and equipped with a glass sealed to the watch case, a cap covering said watch at least partially and a wristlet comprising two half wristlets secured to either side of the watch case by means of spindles about which the half wristlets can pivot.

2. DESCRIPTION OF THE PRIOR ART

There have been many proposals for a watch or a watch case for a wrist watch covered by a cap.

Swiss patent No. CH-A-558 040 describes a case for a watch comprising a protective cap in an extra hard material. In this construction the cap is held in place by perpendicular screws to the plane of the case, passing through the caseband bezel and engaging in tapped blocks disposed under the cap. Here the cap presents a rather complicated cross section due to the presence of the tapped blocks. The bezel of the case band has to be executed in a special shape in order to be adapted to the cap superimposed thereon.

Swiss patent No. CH-A-517 963 (U.S. Pat. No. 3 242 664) describes a case for a watch covered by a metal carbide cap made of an annular part encircling the glass and two diametrically opposed lugs covering the fixing horns of a wristlet. The annular part and the lugs are brazed to the case and the horns respectively. This construction calls for a special tool for securing the cap to the case of the watch and it will be noted that once the cap is secured, the latter cannot be dismantled, at least not using simple tools.

The watch case described in U.S. Pat. No. 4,396,298 contains an electronic module for showing the time. This watch case comprises a back, a resilient part interposed between the back and the module, and a cover. Resilient thin bars engaged in the edges of the back retain the module in the back of the case. The same thin bars serve to secure the cover to the back. The wristlet is secured to the watch case by means of raised lugs in the back. This construction is complicated and requires several bent and shaped pieces. The cover does not constitute a cap as such, but is rather a constituent part of the case.

Document No. DE-C-1 099 773 describes an interchangeable bezel adapted to a wrist watch. Here, the bezel is held in place on the watch with the aid of a wristlet constructed in one piece. The wristlet penetrates a first aperture formed in the bezel, then passes between a first thin bar carried by a first pair of horns of the case of the watch and the case band of the latter, extends along the back of the watch case, passes again between a second thin bar carried by a second pair of horns of the case of the watch and the case band of said case and emerges from the bezel via a second aperture formed in said bezel. In this construction the thin bars do not serve to attach the bezel to the case. Moreover, the proposed construction is complicated and heavy and considerably modifies the appearance of the original case of the watch.

Document No. FR-A-1 092 554 proposes in particular a clasp for a one-piece wristlet, said clasp being combined with the case of the watch. The case of the watch is pivotally mounted with respect to the bezel frame by means of a hinge, said hinge in no way serving to attach the wristlet to the watch case.

Finally, the timepiece described in document No. FR-A-2 329 002 has a bezel type which constitutes an integral part of the watch case of the watch and contributes to its being well sealed and not an interchangeable cap fitting a case made in one piece as in the present invention.

BRIEF SUMMARY OF THE INVENTION

The present invention provides a system in which the spindles securing the two half wristlets also serve at the same time as means for securing the cap to the case. The advantages of such an arrangement will emerge clearly from a study of the following description and from an examination of the drawings which illustrate it by way of example and in which:

DETAILED DESCRIPTION OF PREFERRED EMBODIMENTS OF THE INVENTION

Figure 1:
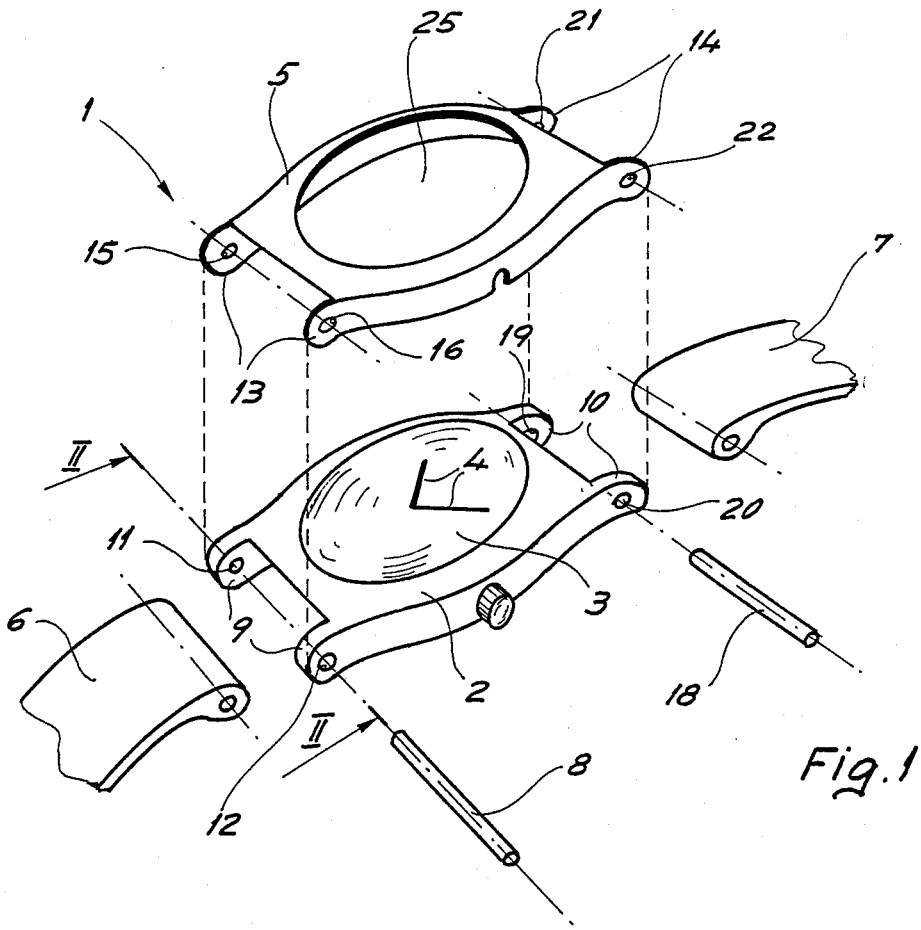
FIG. 1 is an exploded perspective view of the watch of the invention.

The watch 1 of FIG. 1 essentially comprises a watch case 2 comprising means for showing the time, a glass 3 through which hands 4 are visible, a cap 5 for covering the watch at least partially and a wristlet formed in this instance of two half wristlets 6 and 7 capable of being secured to the watch case by spindles 8 and 18. FIG. 1 shows clearly that the spindles 8 and 18 which join the half wristlets 6 and 7 respectively to the watch case also serve at the same time as means of securing the cap 5 to the watch case 2.

In the embodiment shown in FIG. 1, the watch case 2 comprises two pairs of horns 9 and 10 between which the half wristlets 6 and 7 respectively are articulated. The half wristlet 6 is articulated about a spindle 8 inserted in the first holes 11 and 12 formed in the horns 9. The half wristlet 7 is articulated in the same manner between the horns 10 provided with holes 19 and 20. FIG. 1 also shows that the cap 5 comprises two pairs of lugs 13 and 14. The pair of lugs 13 is provided with second holes 15 and 16 through which the spindle 8 also passes. The same applies in the case of the pair of lugs 14 which are provided with holes 21 and 22. The spindle 8 therefore serves both to secure the half wristlet 6 to the watch case 2 and to secure the cap 5 onto said watch case 2. The spindle 18 serves the same purpose for the half wristlet located on the opposite side of the watch.

Figure 2:
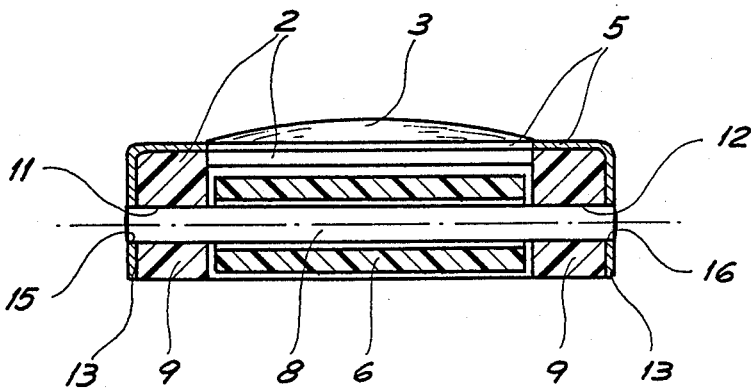
FIG. 2 is a section along the line II—II of FIG. 1, but wherein all the pieces are assembled on top of each other.

FIG. 2, which is a section along the line II—II of FIG. 1, assuming all the parts are assembled, shows the horns 9 of the watch case 2 and the first holes 11 and 12 formed in the horns 9.

The watch case 2 and the horns 9 are surrounded by the cap 5 of which the pair of lugs 13 are visible, equipped with the second holes 15 and 16. The spindle 8, which is inserted into the horns 9 of the watch case, holds both the cap 5 and the half wristlet 6 firmly to said watch case. In this way the cap and the half wristlet are joined to the watch case in a single operation which consists, once the cap has been placed on the watch case, of inserting the spindle through the various holes referred to above.

The spindles 8 and 18 can be pins driven into the first holes 11, 12 and 19, 20. FIG. 2 shows that the pin 8 emerges from the horns 9 to penetrate the second holes 15 and 16 of the lugs. In this construction the lugs 13 cover the outer walls of the horns 9. One could, however, devise other solutions, one of which would for example consist in placing the lugs 13 on the inner walls of the horns 9.

Instead of being a driven pin the spindle 8 could be a thin bar with a spring. In this embodiment, the second holes 15 and 16 would have to be adapted to the diameter of the pivots of a small bar of this type, that is they would have to have a diameter smaller than the diameter of the first holes 11 and 12.

The cap 5 shown in FIG. 2 surrounds the glass 3 and extends to the bottom of the vertical section of the watch case 2. In some instances one could make the vertical part of the cap abut against edges which could be formed in the lower periphery of the watch case. This arrangement would give a better seating to the cap just as it could be of advantage for purely aesthetic reasons.

The cap 5 could be made of any material, such as plastic, metal or even ceramic. If the cap is thin enough, say 0.3 mm, it could cover a watch case having an aesthetic shape noted for its commercial success without having to modify said shape, the aim being to give the impression that the watch is executed in a material different from that known earlier. For example, the Swatch watch (registered trade mark), known worldwide for its characteristic shape and its very low price, could constitute the underlying watch case defined in the present invention, said watch case then being covered by a cap giving this watch a new aesthetic appearance without changing its famous shape and without significantly altering its selling price. Thus, the watch case of this famous watch would remain the same, in a plastic material and manufactured in large quantities, a cap in gold or in a gilded metal would alter its aesthetic appearance, giving the impression that the watch were made of metal and this without making any change to its shape.

The above-mentioned advantages are due, above all, to the fact that the cap described can be mounted without difficulty on the watch case and without need for resorting to other means than those which are normally used to secure the wristlet to the watch case. All the means known to date for modifying the appearance of the watch could only be implemented by the manufacture itself by securing with screws, soldering, bonding, etc. Modification of the appearance of the watch after completion of its manufacture was therefore no longer possible. In contrast, the present invention makes such a modification possible, in any case for the watch seller, and possibly even by the wearer of the watch. For this purpose and according to the claimed method of assembly, the cap is placed on the watch case, a half wristlet is presented between one of the pairs of horns, the spindle is inserted in the first and second holes which are provided respectively in the horns and the lugs and the same operations are repeated for the other half wristlet.

Reference has been made in the above description of a twin pair of horns adjoining the watch case. The present invention is not limited to this particular embodiment. It would be possible to have between the two horns of a wristlet attachment one or two additional horns as set out for example in the specification of No. CH-A-647 917 (U.S. Pat. No. 4,624,581).

The cap shown in FIG. 1 has an opening 25 which surrounds the glass 3. Without there being any need to illustrate this, it is clear that this opening could comprise a protective grid intended to protect the glass. This large-mesh grid could be stamped out at the same time as the cap itself is stamped. The centre of the grid could also include a round or shaped disc on which a mark could appear.

I claim:

1. A watch (1) comprising a watch case (2) constructed in one piece and equipped with a glass (3) sealed to the watch case, a cap (5) at least partially covering said watch and a wristlet comprising two half wristlets (6, 7) secured on either side of the watch case by means of spindles (8, 18) about which the half wristlets can pivot said spindles also serving at the same time as means for securing said cap to said watch case, said watch case having a first pair (9) of horns adjacent to one side of the watch case and a second pair (1) of horns adjacent to another side of the watch case, said one side and another side being opposite sides of the watch, each of said horns being equipped with a hole (11, 12; 19, 20), said cap having two pairs of lugs being provided with holes (15, 16; 21, 22) and wherein when the cap is mounted on the watch case the said pairs of holes in the horns on each opposing side of the watch case are in alignment with the holes in the lugs of said cap, whereby each spindle may pass through holes in a pair of horns and a pair of lugs so as to secure said half wristlets and said cap to said watch case.

2. A watch according to claim 1, wherein said spindle is a pin, and in construction of said watch said pin is driven through said holes so that each pin passes through four holes.

3. A watch according to claim 1, wherein each of said lugs is disposed outside one of said horns.

4. A watch according to claim 3, also provided with a protective grid covering the glass, wherein said grid is part of the cap.

5. A watch according to claim 1, also provided with a protective grid, wherein said grid is a part of said cap.

6. A watch according to claim 1, wherein the watch case is made of a plastic material.

7. A watch according to claim 1, wherein the cap is a metal cap.

8. A watch according to claim 1, wherein the cap is made of gold or gold-plated steel.

9. A method for the assembly of the watch having a watch case wherein said watch case is provided with a first pair of horns adjacent to one side of the watch case and a second pair of horns adjacent to another side of the watch, said one side and another side being opposite sides of the watch, each of said horns being equipped with a hole, a cap being provided with lugs, said lugs also being provided with holes, wherein when the cap is mounted on the watch case the said pairs of holes in the horns on each opposing side of the watch case are in alignment with the holes in the lugs of said cap, whereby each spindle may pass through holes in a pair of horns and a pair of lugs so as to secure a half wristlet to said watch case, comprising the following sequence of operations:

the cap is placed on the watch case, a half wristlet is presented between one of the pairs of horns, the spindle is inserted into the first and second holes provided in the horns and lugs respectively, the same operations being repeated for the other half wristlet.

10. A cap (5) having a central opening (25) and lugs (13, 14), said cap being adapted to fit over a watch case (2) comprising horns (9, 10) provided with openings (11, 12; 19, 20) said watch case being made of one piece with a glass (3) sealed thereon, and materially enhancing or modifying the appearance of said watch, said lugs being provided with openings (15, 16; 21, 22) whereby spindles (8, 18) may be employed to simultaneously secure both the cap and wristlets to said watch case by passing through said holes provided in said horns and said lugs, said central opening being so disposed as to reveal the glass of the watch.

* * * * *